US009346526B2

(12) United States Patent
Ottosson et al.

(10) Patent No.: US 9,346,526 B2
(45) Date of Patent: May 24, 2016

(54) METHOD OF AND A DEVICE FOR REDUCING THE AZIMUTHAL TORQUE ACTING ON A PULLING POD UNIT OR AZIMUTH THRUSTER

(71) Applicant: ROLLS-ROYCE AKTIEBOLAG, Kristinehamn (SE)

(72) Inventors: Anders Ottosson, Karlstad (SE); Rikard Johansson, Hammarö (SE)

(73) Assignee: Rolls-Royce Aktiebolag (SE)

( * ) Notice: Subject to any disclaimer, the term of this patent is extended or adjusted under 35 U.S.C. 154(b) by 52 days.

(21) Appl. No.: 14/358,987

(22) PCT Filed: Oct. 5, 2012

(86) PCT No.: PCT/SE2012/051067

§ 371 (c)(1),
(2) Date: May 16, 2014

(87) PCT Pub. No.: WO2013/074017

PCT Pub. Date: May 23, 2013

(65) Prior Publication Data

US 2014/0322021 A1 Oct. 30, 2014

(30) Foreign Application Priority Data

Nov. 18, 2011 (SE) ..... 1151101

(51) Int. Cl.
*B63H 20/32* (2006.01)
*B63H 21/36* (2006.01)
(Continued)

(52) U.S. Cl.
CPC ..... *B63H 1/26* (2013.01); *B63H 5/125* (2013.01); *B63H 25/42* (2013.01)

(58) Field of Classification Search
CPC ..... B63H 1/00; B63H 1/04; B63H 1/10; B63H 1/26; B63H 25/42; B63H 2001/04
USPC ..... 440/49, 53, 61 R, 61 S, 67, 76; 416/203
See application file for complete search history.

(56) References Cited

U.S. PATENT DOCUMENTS

2007/0123118 A1* 5/2007 White ..... B63H 5/125 440/75
2012/0129411 A1* 5/2012 Kodera ..... B63H 5/1252 440/3

FOREIGN PATENT DOCUMENTS

EP 1 270 403 A2 1/2003
JP 2004-090841 3/2004
(Continued)

OTHER PUBLICATIONS

JP 2009214650 published Sep. 24, 2009, machine-generated English-language translation downloaded from www.jpo.go.jp, 7 pages.
(Continued)

*Primary Examiner* — Daniel V Venne
(74) *Attorney, Agent, or Firm* — Eric L. Sophir; Dentons US LLP

(57) ABSTRACT

This invention relates to a device and method of reducing the azimuthal torque acting on a pulling pod unit or azimuth thruster (1) having a rotary pod housing (2) with a substantially vertical slewing axis (3) and a fixed downwardly directed first fin (4) carried by the pod housing (2) abaft the slewing axis (3), wherein said first fin is in the form of an elongated strip-shaped vane (4) and extends abaft the slewing axis (3) along the pod housing (2) to the vicinity of a rear end (5) thereof.

18 Claims, 1 Drawing Sheet

(51) Int. Cl.

| | |
|---|---|
| ***B63H 1/26*** | (2006.01) |
| ***B63H 25/42*** | (2006.01) |
| ***B63H 5/125*** | (2006.01) |

(56) References Cited

FOREIGN PATENT DOCUMENTS

| | | | |
|---|---|---|---|
| JP | 2009214650 | A | 9/2009 |
| WO | WO 01/54973 | A1 | 8/2001 |
| WO | WO 2005/012075 | A1 | 2/2005 |
| WO | WO 2009/0127774 | A1 | 10/2009 |

OTHER PUBLICATIONS

JP 2004-090841 published Mar. 25, 2004, machine-generated English-language abstract translation downloaded from http://worldwide.espacenet.com, 1 page.
JP 58112894 published Jul. 5, 1983, machine-generated English-translation abstract from EPODOC/EPO.
International Search Report from PCT/SE2012/051067, mailed Feb. 21, 2013.

* cited by examiner

METHOD OF AND A DEVICE FOR REDUCING THE AZIMUTHAL TORQUE ACTING ON A PULLING POD UNIT OR AZIMUTH THRUSTER

CROSS-REFERENCE TO RELATED APPLICATIONS

This application claims priority to PCT/SE2012/051067, filed Oct. 5, 2012, entitled "A METHOD OF AND A DEVICE FOR REDUCING THE AZIMUTHAL TORQUE ACTING ON A PULLING POD UNIT OR AZIMUTH THRUSTER," which claims priority to Swedish Patent Application No. 115110101, filed Nov. 18, 2011, entitled "A METHOD OF AND A DEVICE FOR REDUCING THE AZIMUTHAL TORQUE ACTING ON A PULLING POD UNIT OR AZIMUTH THRUSTER," all of which are incorporated by reference in their entirety.

TECHNICAL FIELD

The present invention relates to a method of reducing the azimuthal torque acting on a pulling pod unit or azimuth thruster having a rotary pod housing with a substantially vertical slewing axis and a fixed downwardly directed first fin carried by the pod housing abaft the slewing axis.

It also relates to a device for reducing the azimuthal torque acting on a pulling pod unit or azimuth thruster having a rotary pod housing with a substantially vertical slewing axis and a fixed downwardly directed first fin carried by the pod housing abaft the slewing axis.

BACKGROUND ART

The azimuthal torque around the slewing axis of a pod unit or azimuthal thruster has to be handled by an installed steering engine for all combinations of steering angles, propeller speeds and ship speeds.

The main causes of the azimuthal torque are:

- The lateral force that is created due to an oblique flow toward the propeller together with the distance between the propeller and the vertical slewing axis. This distance forms one arm of a lever that is pivotal around the slewing axis.
- At turning an oblique flow to the propeller blades will give a varying angle of attack over a complete turn at a given radius. This variation causes a torque that affects the total azimuthal torque.
- The distance between the load center of the pod housing and the vertical slewing axis will together with the resulting lateral force give a torque that affects the total steering torque.

A common way of reducing the azimuthal torque for pod units and azimuth thrusters is to place a fin with a wing profile abaft the slewing axis. The fin creates a lateral force due to the angle of attack that results, especially at turning of the pod unit. The lateral force gives rise to a torque that acts in a direction opposite to the sum of other torque contributions and therefore it reduces the maximum azimuthal torque.

At certain operating conditions, a fin with a wing profile placed in the slip stream of a propeller may generate a forward directed force, which is greater than the total drag on the fin that acts in the opposite direction. Thereby, this regain of the rotational energy in the slip stream will give a positive thrust contribution that increases the efficiency of the pod unit. The distance between the slewing axis and a center of the lateral forces acting on the fin forms a second arm of the lever.

The use of such a fin is disclosed in WO 2005/012075 A1 (Rolls-Royce Marine AS) and JP 2004090841 (A) (Kawasaki Heavy Ind. Ltd.), for example. However, a fin will project a comparatively large distance from the pod body, which causes an increased risk of grounding. A conventional fin will also give disadvantages in the form of more complicated handling and transportation of the pod unit on docking the ship, for example, and increase the dimensioning loads for mainly pod housings and slewing bearings. In addition, the complex shape (the wing profile) may cause the manufacturing costs to be relatively high.

JP 2009214650 (A) (Universal Shipbuilding Corp.) discloses an invention, the object of which is to provide a pod type propulsion unit capable of reducing propulsion resistance without developing a separation phenomenon in a liquid flow at manufacturing cost suppressed to a low level by a simple configuration. This object is stated to be achieved in that the pod type propulsion unit comprises a propeller, a pod body, and a strut, wherein rectangular-plate vanes (current plates) are fixed to the side surface of the pod body so as to be disposed parallel to the axial direction of the pod body and in the direction normal to (the same as the radial direction of) the side surface of the pod body. The amount of projection of the vane is 40% or smaller of the radius of the propeller, so that the projection is extremely small compared to conventional known fins. Further, from WO 01/54973 there is known a POD arrangement having fins, but not for the purpose of reducing torque or reducing resistance, but to improve cooling.

SUMMARY OF THE INVENTION

The object of the present invention is to reduce the risk of grounding in comparison to that for a pod unit or azimuth thruster having a downward extending fin, but at the cost of a slightly reduced efficiency of the pod unit or thruster.

In a method of the kind specified in the first paragraph above, this object is achieved in accordance with the present invention by reducing the first fin to an elongated vane and extending it abaft the slewing axis along the pod housing to the vicinity of a rear end thereof.

Similarly, in a device of the kind specified in the second paragraph above, this object is achieved in accordance with the present invention in that the first fin is reduced to an elongated vane and extends abaft the slewing axis along the pod housing to the vicinity of a rear end thereof.

A vane, i.e. a strip-shaped plate, placed on the rear portion of the pod body, abaft the slewing axis, reduces the azimuthal torque. At pivoted conditions, the "strip" or vane changes the distribution of water pressure for the rear portion of the pod unit in such a manner that the azimuthal torque is reduced. The manufacturing cost for the vane or strip is relatively low. In some cases, an alternative cost might be to increase the torque capacity of the steering engine, which cannot always be done simply and at a reasonable cost.

Advantages of a vane/strip that may be achieved in accordance with the invention;

- Can be introduced at a "late moment", i.e. it has a minor effect on the dimensioning loads.
- Low manufacturing cost.
- The reduction of the azimuthal torque is smaller than for an installation of a fin with wing profile at a comparable position.
- The risk of grounding is far lower than for a design using a bottom fin.

Suitably, the pod housing has an upward extending second fin intended for suspension of the pod unit or azimuth thruster from a marine vessel, and the second fin has a portion located adjacent the pod housing. Then, said portion preferably is extended along the pod housing to form a second vane extending to the vicinity of said rear end thereof. Thereby, a slight further reduction of the azimuthal torque will be achieved and the unit efficiency will be slightly improved.

BRIEF DESCRIPTION OF THE DRAWINGS

In the following, the invention will be described in more detail with reference to preferred embodiments and the appended drawings.

MODE(S) FOR CARRYING OUT THE INVENTION

Figure 1:
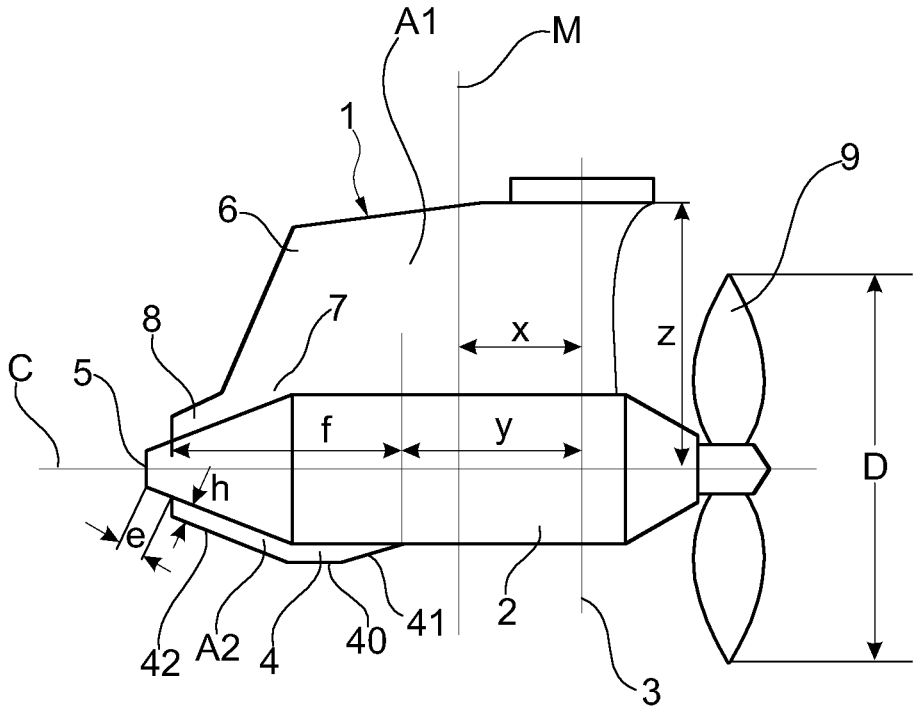
FIG. 1 is a schematic side view of a preferred embodiment of a pod unit or azimuth thruster according the present invention, and, FIG. 2 is an end view of a lower portion of the pod unit or azimuth thruster of FIG. 1 viewed from the downstream end thereof.
Figure 2:
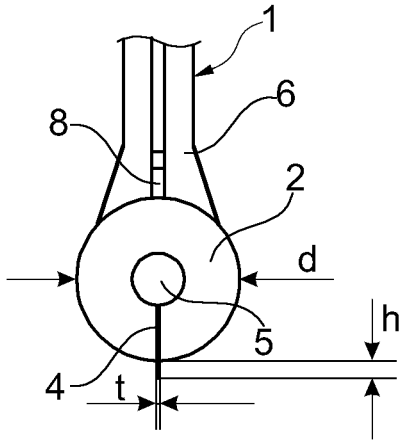

FIG. 1 shows a pulling pod unit or azimuth thruster 1 having a rotary pod housing 2 with a diameter d and with a substantially vertical slewing axis 3, around which the pod unit or azimuth thruster may be rotated, wherein the slewing axis 3 is positioned a distance x in front of the vertical center line M of the pod housing 2. Abaft the slewing axis 3, the pod housing carries a fixed, downwardly directed first fin 4.

In accordance with the present invention, the first fin 4 is in form of an elongated strip-shaped vane 4 and extends abaft the slewing axis 3 along the pod housing 2 to the vicinity of a rear end 5 thereof, having a relatively small height h radially outward from the pod housing 2, that is substantially smaller than the comparable projection of the traditional fin. According to the preferred shown embodiment the fin 4 has a front portion 41 that presents a lower/outer edge 41' presenting a sharp angle in relation to the horizontal extension of the pod housing 2. As a consequence this portion 41 presents a triangular shape having its sharp end in level with the periphery of the pod housing 2, pointing forward from that sharp end the edge 41' presents a continuously increasing height until it reaches the height h of, and meet with, the intermediate portion 40 of the fin 4. This intermediate portion 40 presents an edge 40' that is parallel with the center line of the pod housing 2. Connected to the end of the intermediate portion 40 a rear portion 42 extends abaft, with the edge 42' extending parallel with the conical rear portion of the pod housing 2, terminating a distance e from the rear end 5 of the pod housing 2. As is evident for the skilled person it could as well extend all the way to the aft end of the pod housing 2.

As presented in FIG. 1 the starting point of the fin 4 is positioned a distance y from the slewing axis 3, which in most applications preferably is relatively small, but in some applications a distance y that is larger than the distance x between the vertical center portion of the pod housing 2 and the slewing axis 3 may be desired. It is shown that the horizontal extension f of the fin 4 may be larger than the distance y between the slewing axis 3 and starting point of the fin 4 but indeed could as well be shorter.

The diameter D of the propeller is preferably in the range of 1 meter-10 meter, most preferred 3 meter-8 meter.

The distance y to the starting point of the fin 4 is preferably in the range of 0.1 D meter-2 D meter, most preferred 0.5 D meter-1.5 D meter (it is to be understood that in this formula (and following) merely the number representing the size in meter of the propeller is to be used).

The height h of the fin 4 is preferably in the range of the 0.005 D meter-0.2 D meter, most preferred 0.01 D meter-0.05 D meter.

The thickness t of the fin 4 is preferably in the range 5 mm till 100 mm, most preferred 10 mm till 30 mm.

The area A2 of the fin 40 is preferably in the range of 0.001 D $mm^2$-0.10 D $mm^2$, more preferred 0.005 D $mm^2$-0.02 D $mm^2$.

The diameter d of the pod housing 2 according to a preferred embodiment is in the range of 0.1 D-1 D meter, more preferred 0.2 D-0.7 D meter.

In the preferred embodiment the strip 4 is produced from a standard sheet of metal, implying in principle no machining, but merely cutting of defined pieces that are easily attached and integrated by means of welding.

Further, the pod housing 2 has an upward extending second fin 6 intended for suspension of the pod unit or azimuth thruster 1 from a marine vessel (not shown), and the second fin 6 has a portion 7 located adjacent the pod housing 2. The portion 7 preferably is extended along the pod housing 2 to form a second vane 8 extending to the vicinity of said rear end 5 thereof. Thereby, a slight further reduction of the azimuthal torque will be achieved and the unit efficiency will be slightly improved.

The invention is not limited by what that is described above but maybe varied within the scope of the claims. For instance it is evident that skill person knows that there is a big variety of different materials that can be used to fulfill the function of the fin 4, but that a weld able metal, e.g. steel, will often be preferred.

Furthermore, in some applications, the fin may be bent or twisted in order to meet the flow in a way to improve efficiency at low steering angles, and/or the fin may have a variable height, h that either gradually changes from leading edge to railing edge or changes in steps. The maximum height can be anywhere from leading edge to trailing edge. Moreover the fin may have a variable thickness, t that either gradually changes from leading edge to railing edge or changes in steps. The maximum thickness can be anywhere from leading edge to trailing edge. The fin's leading edge, trailing edge and tip may have 0 mm thickness. Further it is evident for the skilled person that the cross section of the fin could have different shapes. It could for example be rectangular, conical, bell shaped or barrel shaped. Finally, the fin does not need to be single. A second or third fin, preferably positioned parallelly, may improve the performance even further. The additional fins (not shown) can either be located in longitudinal direction (with different y and f measures) or at different angular position below the pod or thruster unit.

The invention claimed is:

1. A device for reducing the azimuthal torque acting on a pulling pod unit or azimuth thruster comprising:

a rotary pod housing with a substantially vertical slewing axis, a propeller, and a fixed downwardly directed first fin comprising a vane in a form of an elongated strip and extending abaft a slewing axis along a pod housing to a vicinity of a rear end of the pod housing, wherein a starting point of said fixed downwardly directed first fin is positioned at a distance (y) abaft the slewing axis in a range of 0.1 D meter≤y≤2 D meter, wherein D is a diameter of said propeller.

2. The device according to claim 1, wherein the starting point of said fixed downwardly directed first fin is positioned at the distance (y) abaft the slewing axis in a range of 0.5 D meter≤y≤1.5 D meter.

3. A device according to claim 1, wherein a height of said fixed downwardly directed first fin is in a range of 0.005 D meter to 0.2 D meter.

4. The device according to claim 1, wherein a height of said fixed downwardly directed first fin is in a range of 0.01 D meter to 0.05 D meter.

5. The device according to claim 1, wherein an area of said fixed downwardly directed first fin is in a range of 0.001 D $mm^2$ to 0.10 D $mm^2$.

6. The device according to claim 1, wherein an area of said fixed downwardly directed first fin is in a range of 0.005 D $mm^2$ to 0.02 D $mm^2$.

7. The device according to claim 1, wherein said fixed downwardly directed first fin has a substantially flat shape and a thickness in a range of 5 mm to 100 mm.

8. The device according to claim 7, wherein the fixed downwardly directed first fin has a thickness in a range of 10 mm to 30 mm.

9. The device according to claim 1, wherein the pod housing has an upward extending second fin configured for suspension of the pulling pod unit or azimuth thruster from a marine vessel, wherein said upward extending second fin has a portion located adjacent the pod housing, said portion extending abaft along the pod housing to form a second vane extending to the vicinity of said rear end of the pod housing.

10. A device for reducing the azimuthal torque acting on a pulling pod unit or azimuth thruster comprising:

a rotary pod housing with a substantially vertical slewing axis, a propeller, and a fixed downwardly directed first fin carried by the pod housing abaft the slewing axis, wherein said fixed downwardly directed first fin is a vane arranged in a form of an elongated strip, extending abaft the slewing axis along the pod housing to a vicinity of a rear end of the pod housing, wherein a starting point of said fixed downwardly directed first fin is positioned at a distance (y) abaft the slewing axis in a range of 0.1 D meter≤y≤2 D meter, wherein D is a diameter of said propeller.

11. The device according to claim 10, wherein the starting point of said fixed downwardly directed first fin is positioned at a distance (y) abaft the slewing axis in a range of 0.5 D meter≤y≤1.5 D meter.

12. The device according to claim 10, wherein the pod housing has an upward extending second fin intended for suspension of the pulling pod unit or azimuth thruster from a marine vessel, wherein the upward extending second fin has a portion located adjacent the pod housing, said portion extending abaft along the pod housing to form a second vane extending to the vicinity of the rear end of the pod housing.

13. The device according to claim 10, wherein a height of said fixed downwardly directed first fin is in a range of 0.005 D meter to 0.2 D meter.

14. The device according to claim 10, wherein a height of said fixed downwardly directed first fin is in a range of 0.01 D meter to 0.05 D meter.

15. The device according to claim 10, wherein an area of said fixed downwardly directed first fin is in a range of 0.001 D $mm^2$ to 0.10 D $mm^2$.

16. The device according to claim 15, wherein the area of said fixed downwardly directed first fin is in a range of 0.005 D $mm^2$ to 0.02 D $mm^2$.

17. The device according to claim 10, wherein said fixed downwardly directed first fin has a substantially flat shape and a thickness in a range of 5 mm to 100 mm.

18. The device according to claim 10, wherein said fixed downwardly directed first fin has a substantially flat shape and a thickness in a range of 10 mm to 30 mm.

* * * * *